US007887290B2

(12) United States Patent
Chen et al.

(10) Patent No.: US 7,887,290 B2
(45) Date of Patent: Feb. 15, 2011

(54) BLOWER

(75) Inventors: Shi-Han Chen, Taoyuan Hsien (TW); Tsu-Liang Lin, Taoyuan Hsien (TW)

(73) Assignee: Delta Electronics Inc., Taoyuan Hsien (TW)

( * ) Notice: Subject to any disclaimer, the term of this patent is extended or adjusted under 35 U.S.C. 154(b) by 193 days.

(21) Appl. No.: 12/003,833

(22) Filed: Jan. 2, 2008

(65) Prior Publication Data

US 2008/0107523 A1 May 8, 2008

Related U.S. Application Data

(63) Continuation-in-part of application No. 11/316,732, filed on Dec. 27, 2005, now Pat. No. 7,338,256.

(30) Foreign Application Priority Data

Jan. 27, 2005 (TW) ..... 94102459 A
Nov. 16, 2007 (TW) ..... 96143390 A

(51) Int. Cl.
*F04D 29/40* (2006.01)

(52) U.S. Cl. ..... 415/206; 415/212.1

(58) Field of Classification Search ..... 416/195, 416/194, 196 R, 182, 185; 415/206, 182.1, 415/208.1, 175, 203, 213.1, 214.1
See application file for complete search history.

(56) References Cited

U.S. PATENT DOCUMENTS 6,884,033 B2 * 4/2005 Liao ..... 415/206
6,964,556 B2 * 11/2005 Chiu et al. ..... 415/205
2009/0053052 A1 * 2/2009 Hwang et al. ..... 415/203

* cited by examiner

*Primary Examiner*—Edward Look
*Assistant Examiner*—Dwayne J White
(74) *Attorney, Agent, or Firm*—Birch, Stewart, Kolasch & Birch, LLP

(57) ABSTRACT

A blower includes a housing and an impeller. The housing has a main inlet and at least one secondary inlet. The impeller is disposed in the housing and has a hub, a plurality of blades and at least one annular plate. Those blades are disposed around the hub. The annular plate is connected to those blades and partially blocked the secondary inlet.

18 Claims, 11 Drawing Sheets

100

BLOWER

CROSS REFERENCE TO RELATED APPLICATIONS

The present invention is a continuation-in-part (C.I.P.) application of U.S. patent application Ser. No. 11/316,732, filed on Dec. 27, 2005 now U.S. Pat. No. 7,338,256, which is entitled "Blower", and claims priority under 35 U.S.C. §119 (a) on Patent Application No. 096143390 filed in Taiwan, Republic of China on Nov. 16, 2007, the entire contents of which are hereby incorporated by reference.

BACKGROUND OF THE INVENTION

1. Field of the Invention

The invention relates to a blower, and in particular to a blower preventing an air leakage and increasing an air pressure.

2. Description of the Related Art

Blowers are often employed to provide high air pressure to a system requiring high backpressure. In FIG. 1, a blower 10 includes a first housing 12*a* and a second housing 12*b*, wherein the first housing 12*a* having a first inlet 14 and an impeller 16. The second housing 12*b* has a second inlet 11 and a rounded region 100. A side outlet 13 is formed whereby the second housing 12*b* and the first housing 12*a* integrate together.

Usually, the profile of the first inlets 14 and the second inlet 11 is circle and are concentric with the impeller 16. The first and the second housings 12*a*, 12*b* cover the rounded region 100, to produce airflow. The first inlets 14 and the second inlet 11, however, are not covered by the first and the second housings 12*a*, 12*b*, allowing an airflow leakage via the first inlets 14 and the second 11 when the impeller 16 is rotated at high speed, resulting in reduced pressure.

SUMMARY OF THE INVENTION

The invention provides a blower comprising a housing and an impeller, wherein the impeller disposed in the housing. The housing includes a side outlet and an inlet with a predetermined profile. The predetermined profile is quadratrical, elliptical, polygonal, non-coaxial circle, or irregularly closed shaped. A flow tunnel is disposed between the impeller and the housing.

The invention further provides a main inlet and a secondary inlet, wherein the secondary inlet extends outwardly from the periphery of the main inlet. The housing further includes a plurality of outer frames assembled by coupling, riveting, engaging, or adhesion.

The invention employs the inlets in different positions with varied shapes to cover an extended flow tunnel toward the blades of the impeller, to prevent an airflow leakage via the inlets when the impeller is rotated at high speed and maintain airflow pressure.

The invention provides a blower for reducing noise when the blower is rotating. The blower includes a housing and an impeller. The housing has a main inlet and at least one secondary inlet. The impeller is disposed in the housing and has a hub, a plurality of blades and at least one annular plate. Those blades are disposed around the hub. The annular plate is connected to those blades and partially blocked the secondary inlet.

In the blower according to the present invention, the secondary inlet can be extended from the periphery of the main inlet or formed near the main inlet independently. The predetermined profile of the main inlet can be circular, elliptical, polygonal, or irregularly closed shaped. The predetermined profile of the secondary inlet can be circular, fan-shaped, polygonal, elliptical, or irregularly closed shaped.

Furthermore, in the blower according to the present invention, the annular plate does not block the main inlet. When the number of the annular plate is two or more, the annular plates can all or partially block the secondary inlet.

Moreover, in the blower according to the present invention, the main inlet is concentric with the impeller. The blades of the impeller can be flat, curved, streamline, or volute shape.

In the blower according to the present invention, the housing can be assembled by a first frame and a second frame. Meanwhile, the first frame includes the main inlet and the secondary inlet, and the second frame includes the other main inlet. The second frame can also include the other secondary inlet. The impeller includes the other annular plate connected to those blades and partially blocked the other secondary inlet.

In the blower according to the present invention, the other secondary inlet formed in the second frame can be extended from the periphery of the other main inlet or formed near the other main inlet independently. The predetermined profile of the other secondary inlet can be circular, fan-shaped, polygonal, elliptical, or irregularly closed shaped, and that of the other main inlet can be circular, elliptical, polygonal, or irregularly closed shaped.

Moreover, the other annular plate does not block the main inlet. When the number of the other annular plate is two or more, the other annular plates can all or partially block the other secondary inlet.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the subsequent detailed description and the accompanying drawings, which are given by way of illustration only, and thus are not limitative of the present invention, and wherein.

DETAILED DESCRIPTION OF THE PREFERRED EMBODIMENTS

Figure 1:
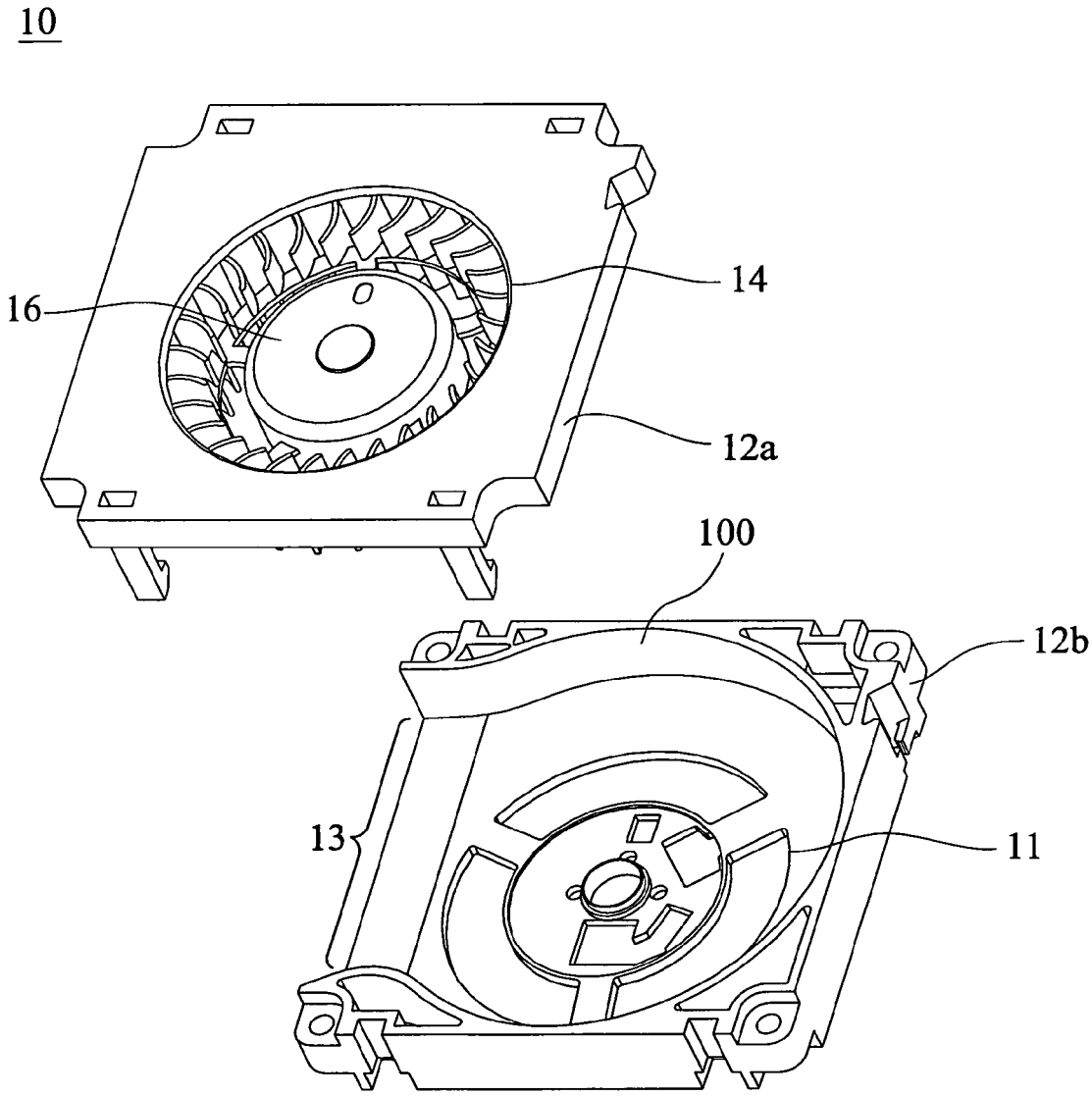
FIG. 1 (RELATED ART)
FIG. 1 is a schematic view of a conventional blower.
Figure 2A:
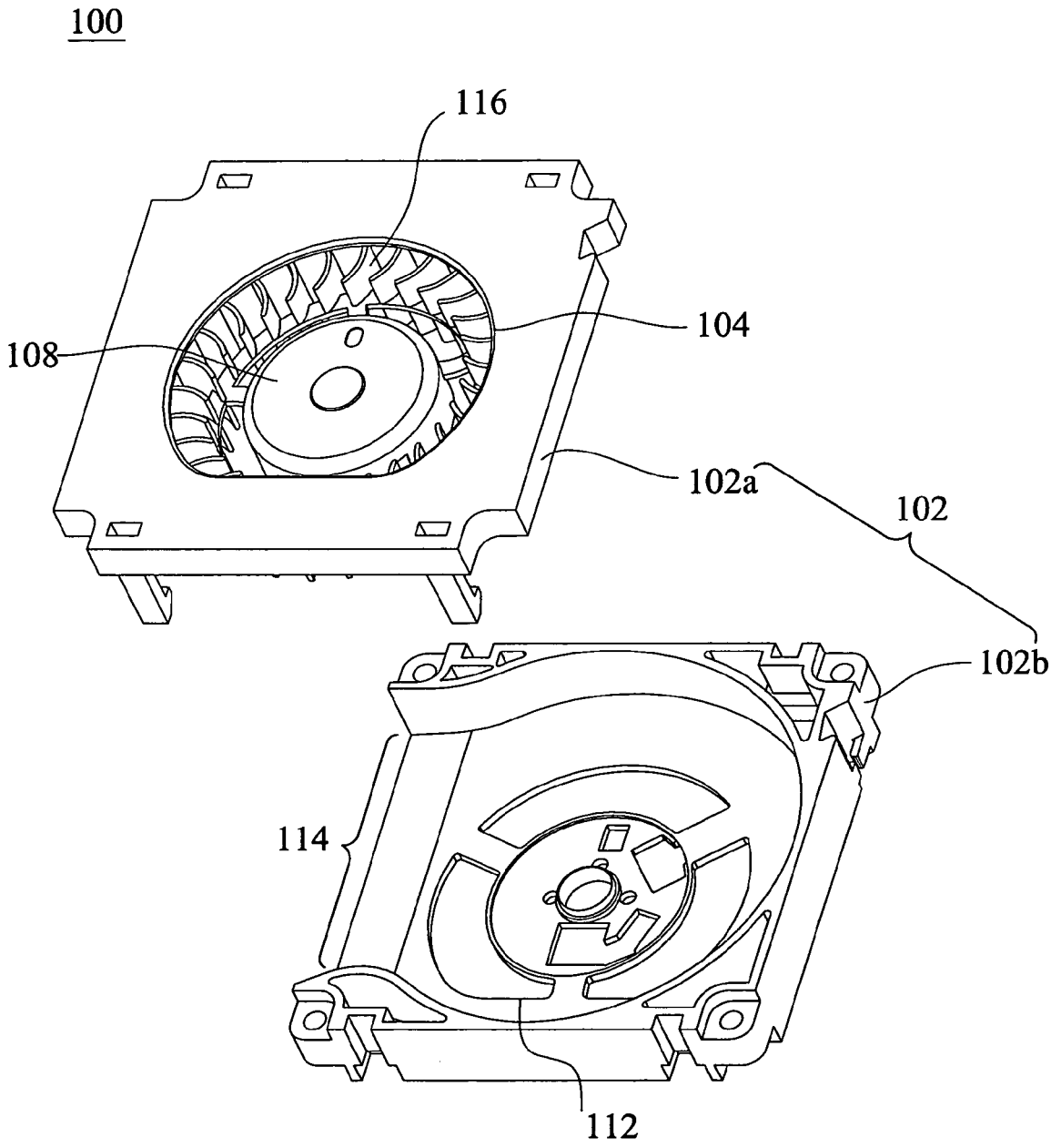
FIGS. 2A and 2B are schematic views of a blower of a first embodiment of the invention.
Figure 2B:
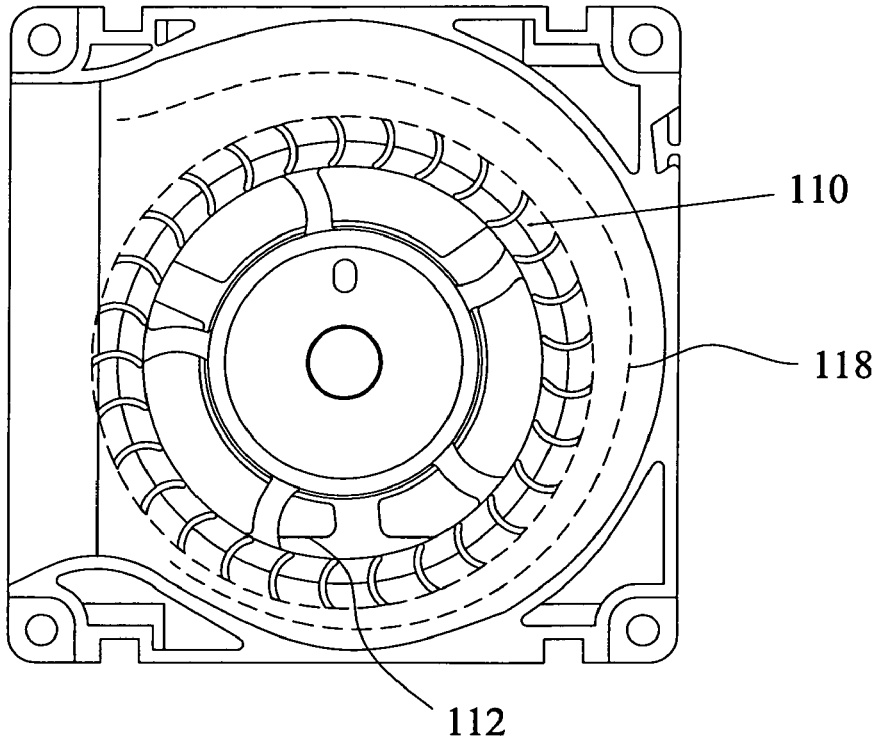

In FIGS. 2A and 2B, a blower 100 of a first embodiment of the invention includes a housing 102 and an impeller 108 disposed in the housing 102. A flow tunnel 118 is formed between the impeller 108 and the housing 102.

The housing 102 includes a first frame 102*a*, a second frame 102*b*, a first inlet 104, a second inlet 112 and a side outlet 114. The first frame 102*a* and the second frame 102*b* are assembled by coupling, riveting, engaging, or adhesion.

The first inlet 104 formed on the first frames 102*a* includes a first quadratrical predetermined profile and the second inlet 112 formed on the outer frames 102*b* includes a second predetermined profile. In the preferred embodiment, the predetermined profile of the first inlet 104 can be elliptical (symbol "106*a*" in FIG. 3A), polygonal (symbol "106*b*" in FIG. 3B), non-coaxial circle (symbol "106*c*" in FIG. 3C), or irregularly closed shaped. The predetermined profile of the second inlet 112 can be quadratrical, elliptical, polygonal, non-coaxial circle, or irregularly closed shaped. The profile of the first inlet 104 can be either the same or different from that of the second inlet 112.

Figure 3A:
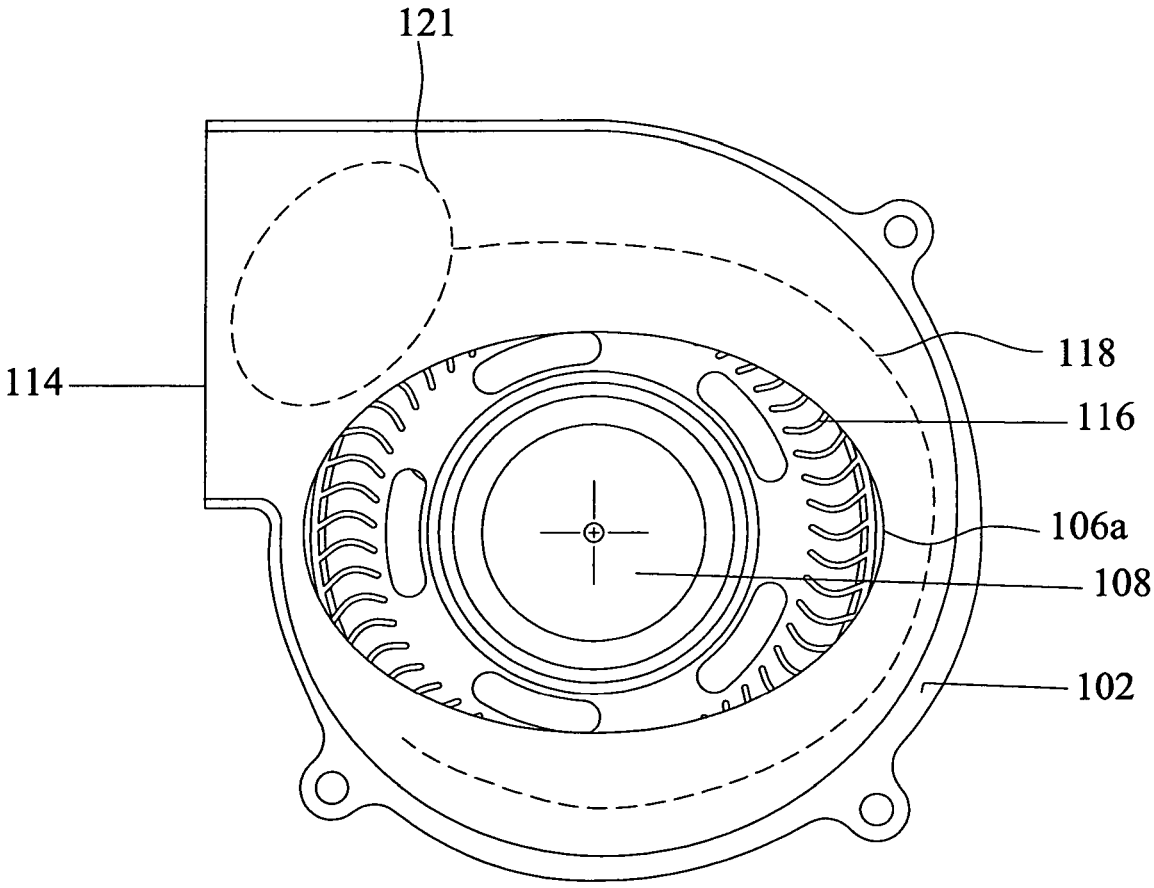
FIGS. 3A to 3C are schematic views of different types of the blowers of the invention.
Figure 3B:
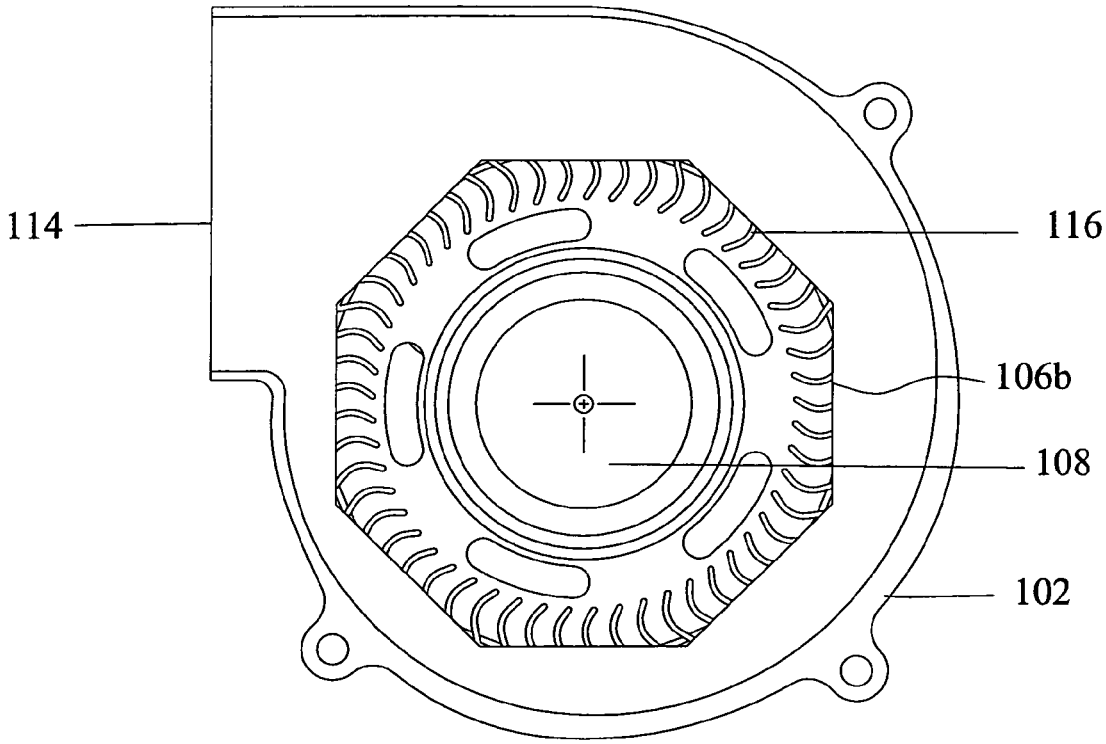
Figure 3C:
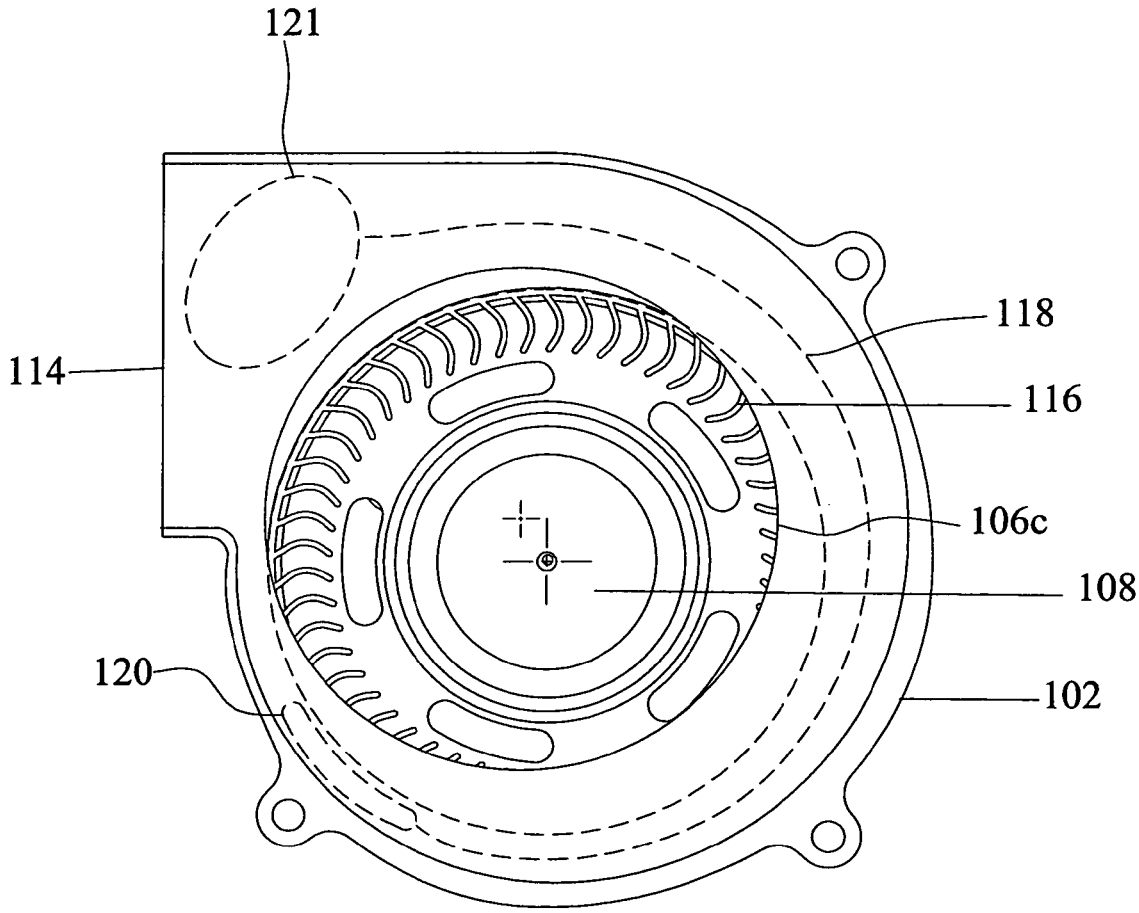

As shown in FIGS. 3A and 3C, the flow tunnel 118 is formed between the impeller 108 and the housing 102. Furthermore, the flow tunnel 118 can be divided into a high-pressure zone 120, ranging from a narrowest part of the flow tunnel 118 to a designated part thereof, and a low-pressure zone 121 of the flow tunnel 118 that approaches the outlet 114. In FIG. 3A, the first inlet 106*a* is elliptical, i.e., the major axis of the ellipse is near the low-pressure zone 121. In FIG. 3C, the first inlet 106*c* is a non-coaxial circle and biased near the low-pressure zone 121. The predetermined profiles of the blowers shown in FIGS. 3A and 3C can increase the air pressure evidently.

The housing 102 is made from plastic, metal or a composite material and is formed by injection, moldings, pressing, cutting or integrally formed as a single unit.

The impeller 108 includes a plurality of blades 116 and a driving device (not shown in Figs.) to rotate the blades 116. An inflow area 110 is encircled by the outer periphery of the blades 116 of the impeller 108. The flow tunnel 118 between the impeller 108 and the housing 102 extends along an axial aspect of the impeller 108 and the housing 102.

The profile of the first and second inlets 104, 112 do not corresponded to the inflow area 110 of the impeller 108, i.e., the housing 102 partially covers the inflow area 110. In other embodiments, the first inlet 104 can expose partially or none of the inflow area 110.

When a working fluid, e.g. an air, passes along the flow tunnel 118, the majority of the working fluid is blocked by the housing 102 and is contained in the flow tunnel 118, thus increasing the rotational speed of the impeller 108 and getting a higher air pressure and a better performance.

Note that the number of the first and second inlets 104, 112 of the housing 102 is not limited to that of the disclosed embodiments. The number of the inlet of the housing 102 can be one or more.

Figure 4A:
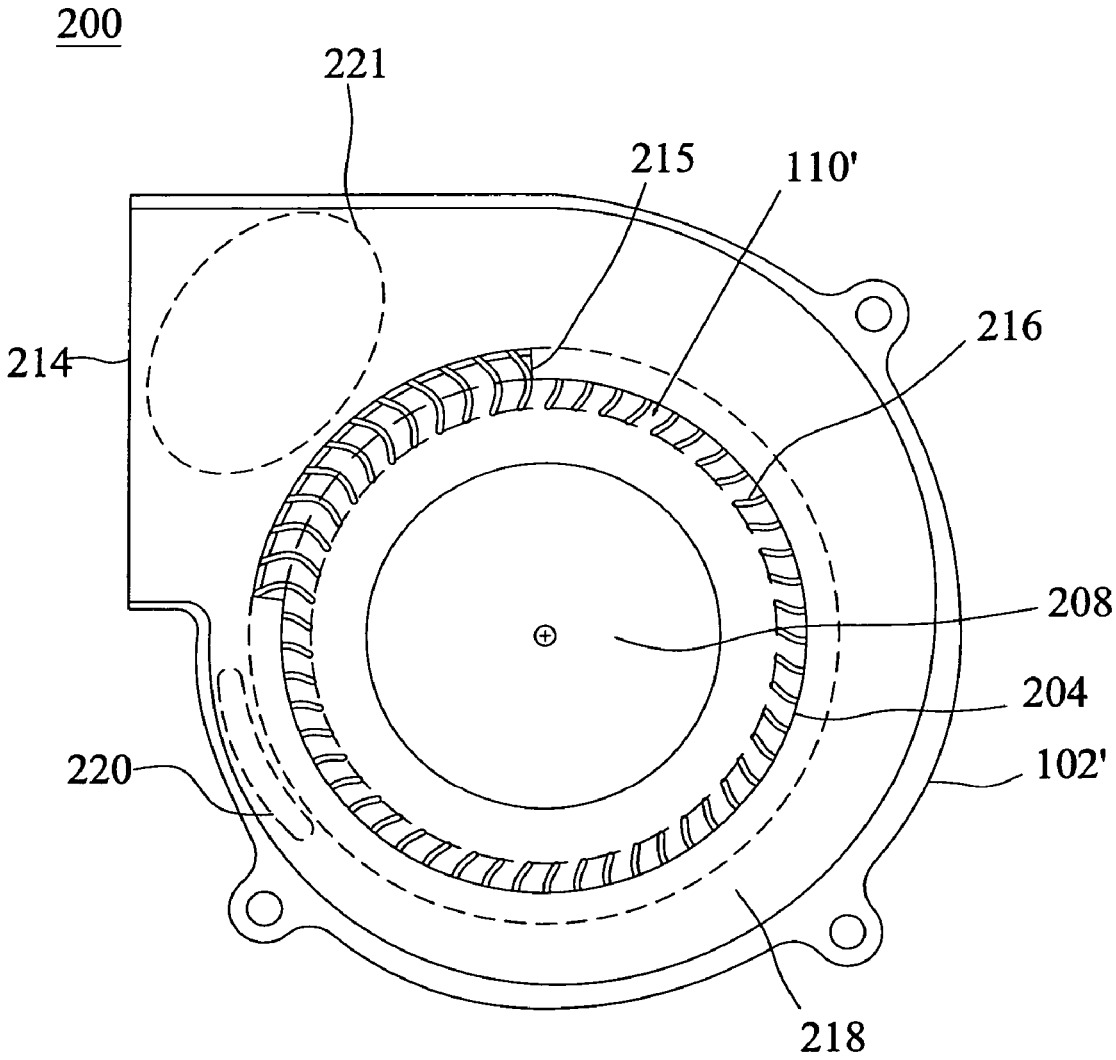
FIGS. 4A and 4B are schematic views of a blower of a second embodiment of the invention.

In FIG. 4A, a blower 200 of the second embodiment includes a housing 102' assembled by two frames, an impeller 208 disposed in the housing 102', wherein the impeller 208 is disposed in the housing 102'. A flow tunnel 218 is formed between the impeller 208 and the housing 102'.

One side of the housing 102' includes a main inlet 204, an outlet 214, and a secondary inlet 215 extending outwardly from the periphery of the main inlet 204. The main inlet 204 exposes partially or none of the inflow area and the secondary inlet increases an exposed zone of the inflow area.

The impeller 208 includes a plurality of blades 216, and an inflow area 110' is encircled by the outer periphery of the blades 216 of the impeller 208.

Based on the invention, the flow tunnel 218 can be divided into a high-pressure zone 220, ranging from a narrowest part of the flow tunnel 218 to a designated part thereof, and a low-pressure zone 221 of the flow tunnel 218 that approaches the outlet 214. The designated part generally is determined according to the desired requirement. That is to say, the secondary inlet 215 approaches the outlet 214 and the low-pressure zone 221.

The outer diameter of the main inlet 204 is partially smaller than that of the impeller 208. With the secondary inlet 215, an exposed zone corresponding to the inflow area 110' can be increased.

Note that the secondary inlet 215 located at the low-pressure zone 221 and extends outwardly from the periphery of the axial main inlet 204 to increase the quantity of the inlet.

Figure 4B:
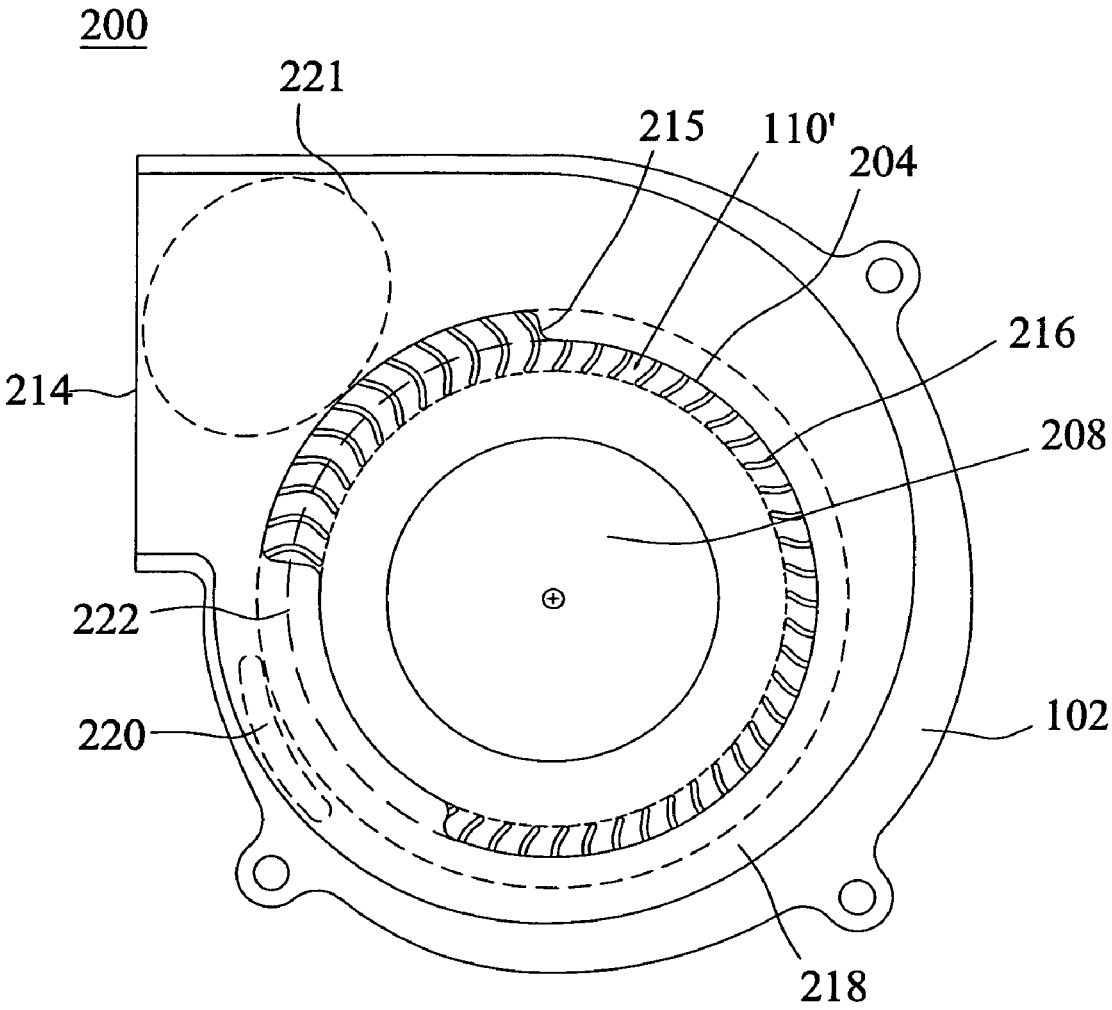

In FIG. 4B, the main inlet 204 includes a protrusion 222 extending from the periphery of the main inlet 204 toward a center thereof for covering a zone between a narrowest part and a designated part of the flow tunnel 218. The main inlet 204 is slightly smaller than the region encircled by the blades 216 of the impeller 208. If the size of the main inlet 204 and the secondary inlet 215 are reduced with respect to the region encircled by the blades 216 of the impeller 208, the air intake amount remains within a desired range, maintaining the working pressure. In preferred embodiments, the protrusion 222 can be of other shapes to dissipate heat to the exterior.

In the preferred embodiment, the profile of the main inlet 204 can be circular, quadratrical, involute, elliptical, polygonal, eccentrically circular, irregularly closed shaped such as the protrusion 222, regular, or irregular. The profile of the secondary inlet 215 can be regular or irregular.

Figure 5A:
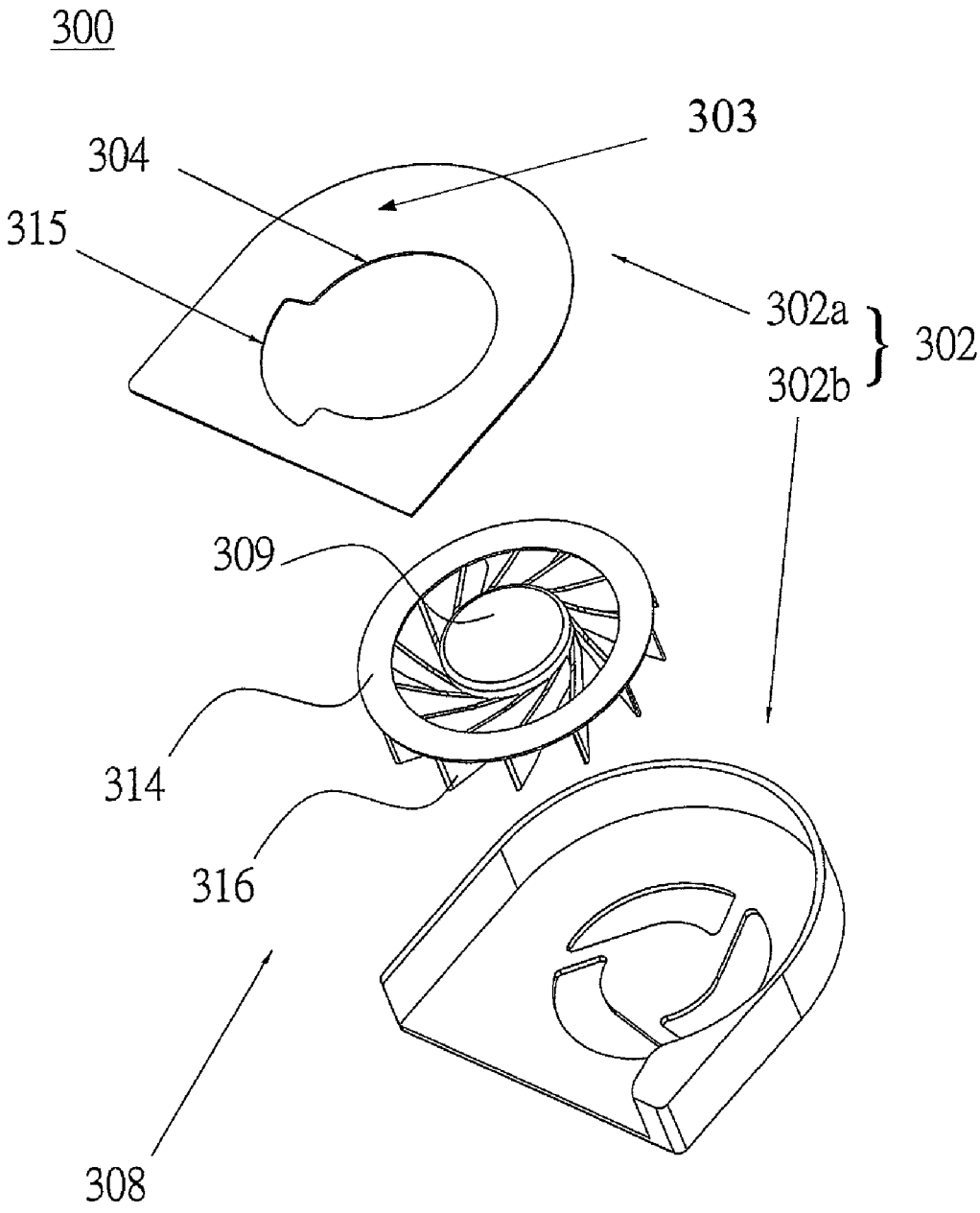
FIGS. 5A and 5B are schematic views of a blower of a third embodiment of the invention.
Figure 5B:
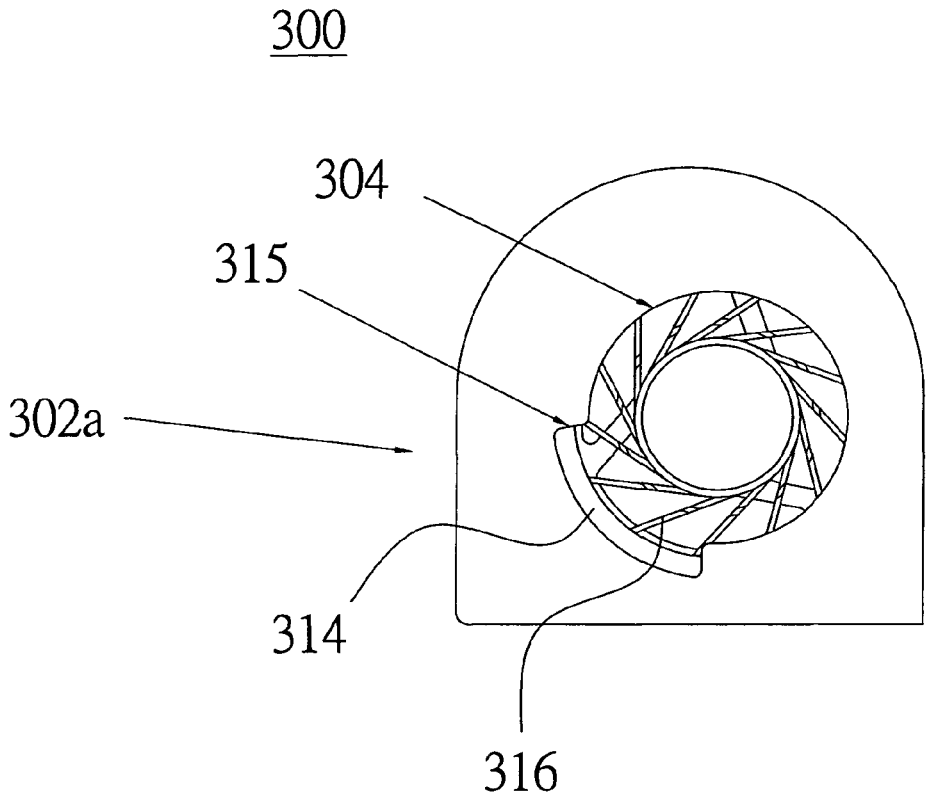

In FIGS. 5A and 5B, a blower 300 of a third embodiment of the invention includes a housing 302 and an impeller 308.

The housing 302 having a top surface 303 includes a first frame 302*a* and a second frame 302*b*. The first frame 302*a* includes a main inlet 304 and at least one secondary inlet 315. The first and second frames 302*a*, 302*b* are assembled so that an accommodating space is formed therebetween. The predetermined profile of the main inlet 304 can be circular, elliptical, polygonal, or irregularly closed shaped. The main inlet 304 is concentric with the impeller 308.

The secondary inlet 315 is extended from the periphery of the main inlet 304 or formed near the main inlet 304 independently. The predetermined profile of the secondary inlet 315 can be circular, fan-shaped, polygonal, elliptical, or irregularly closed shaped but not limited thereto. The number of the secondary inlet 306 can be one, two or more.

The impeller 308 is disposed in the accommodating space i.e., in the housing 302. The impeller 308 includes a hub 309, a plurality of blades 316 and at least one annular plate 314. The blades 316 are disposed around the hub 309. One side of the annular plate 314 is connected to those blades 316. The profile of the blade 316 can be flat, curved, streamline, or volute shape. The annular plate 314 is partially blocked the secondary inlet 306 but not blocked the main inlet 304.

Figure 5C:
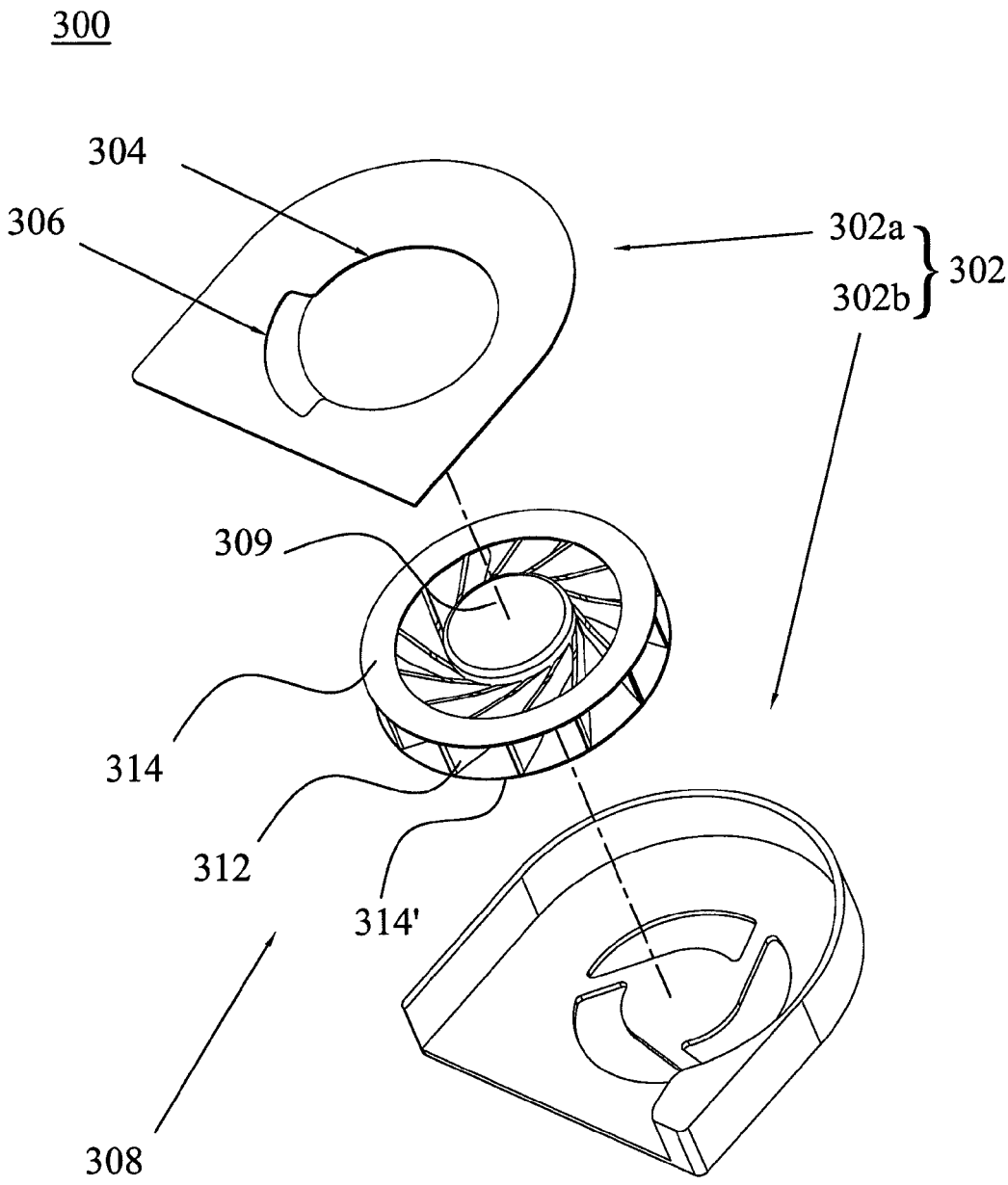
FIG. 5C is a schematic view of a blower with multiple annular plates according to one embodiment of the invention.

Furthermore, the number of the annular plate 314 can be one, two or more. Referring to FIG. 5C, when the numbers of the annular plates 314, 314' is two or more, the annular plates 314, 314' can all or partially block the secondary inlet 306.

In the third embodiment of the invention, the main and secondary inlets are formed on the first frame 302*a* but not limited thereto. The main inlet or the main and second inlets can be formed on the second frame 302*b*. The main and secondary inlets formed on the second frame 302*b* are the same as these formed on the first frame 302*a* so that the detailed description is omitted.

Moreover, the other annular plate can be disposed on the impeller 308 corresponding to the second frame 302*b* and is the same as the annular plate 314 corresponding to the first frame 302*a* so that the detailed description is omitted.

In the third embodiment of the invention, the blower includes the secondary inlet disposed on the housing so that the amount of the intake air can be increased. The annular plate partially blocked the secondary inlet can keep the amount of intake air through the main inlet and change the flow therethrough to reduce the noise when the blower is rotating.

Based on the embodiments, the amount of the intake air in the flow tunnel can be increased by utilization of different sizes, shapes or positions of the inlets. When the blower is operated, the majority of working fluid is limited within the flow tunnel, thus increasing the rotational speed of the impeller, maintaining a higher working pressure and a better performance of the blower.

While the invention has been described with respect to preferred embodiment, it is to be understood that the invention is not limited thereto, but, on the contrary, is intended to accommodate various modifications and equivalent arrangements included within the spirit and scope of the appended claims.

What is claimed is:

1. A blower comprising:

a housing having a top surface, and further comprising a main inlet and at least one secondary inlet; and an impeller disposed in the housing and having:

a hub;

a plurality of blades disposed around the hub; and at least one annular plate connected to the blades and partially blocking the secondary inlet, said at least one annular plate being non-coplanar with the top surface of the housing.

2. The blower as claimed in claim 1, wherein the secondary inlet is extended from the periphery of the main inlet or formed near the main inlet independently.

3. The blower as claimed in claim 1, wherein the main inlet is circular, elliptical, polygonal, or irregularly closed shaped, and the secondary inlet is circular, fan-shaped, polygonal, elliptical, or irregularly closed shaped.

4. The blower as claimed in claim 1, wherein when the number of the annular plate is two or more, the annular plates all or partially block the secondary inlet.

5. The blower as claimed in claim 1, wherein the housing is assembled by a first frame and a second frame, and the first frame comprises the main inlet and the secondary inlet, and the second frame comprises the other main inlet.

6. The blower as claimed in claim 5, wherein the second frame comprises the secondary inlet, the impeller comprises an other annular plate connected to the blades, and the other annular plate partially covers the other secondary inlet.

7. The blower as claimed in claim 6, wherein the other secondary inlet is extended from the periphery of the other main inlet, or formed near the other main inlet independently.

8. The blower as claimed in claim 6, wherein the other secondary inlet is circular, fan-shaped, polygonal, elliptical, or irregularly closed shaped, and the other main inlet is circular, elliptical, polygonal, or irregularly closed shaped.

9. The blower as claimed in claim 6, wherein when the number of the other annular plate is two or more, the other annular plates all or partially cover the other secondary inlet.

10. The blower as claimed in claim 1, wherein the main inlet is concentric with the impeller.

11. The blower as claimed in claim 1, wherein when the number of the secondary inlet is two or more, the annular plate all or partially blocks the secondary inlets.

12. The blower as claimed in claim 1, wherein the profile of the blade is flat, curved, streamline, or volute shape.

13. A blower comprising:

a housing comprising a side outlet and a first inlet; and an impeller disposed in the housing;

wherein the first inlet is non-coaxial and biased near the low-pressure zone, and a flow tunnel is formed between the impeller and the housing and divided into a high-pressure zone ranging from a narrowest part of the flow tunnel and a low-pressure zone approaching the side outlet.

14. The blower as claimed in claim 13, wherein the profile is quadratrical, elliptical, polygonal, non-coaxial, or irregularly closed shaped.

15. The blower as claimed in claim 13, wherein the first inlet is elliptical and a major axis of the ellipse is near the low-pressure zone.

16. The blower as claimed in claim 13, wherein the housing further comprises a second inlet with a second inlet with a second predetermined profile, and wherein the second predetermined profile is quadratrical, elliptical, polygonal, circular failing to concentrate with an axis of the impeller, or irregularly closed shaped.

17. The blower as claimed in claim 13, wherein the housing further comprises a plurality of outer frames assembled by coupling, riveting, engaging or adhesion.

18. The blower as claimed in claim 13, wherein the housing is formed as a single unit by injection, molding, pressing, or cutting.

* * * * *